US009861202B2

(12) United States Patent
Qi et al.

(10) Patent No.: US 9,861,202 B2
(45) Date of Patent: Jan. 9, 2018

(54) CHAIR WITH BI-DIRECTIONAL CONTROLLABLE AIR ROD VALVE

(71) Applicant: Qianglong Furniture Co., Ltd., Huzhou, Zhejiang (CN)

(72) Inventors: Zhiqiang Qi, Zhejiang (CN); Yong Chern Ng, Zhejiang (CN)

(73) Assignee: Qianglong Furniture Co., Ltd., Huzhou (CN)

( * ) Notice: Subject to any disclaimer, the term of this patent is extended or adjusted under 35 U.S.C. 154(b) by 0 days.

(21) Appl. No.: 15/245,196

(22) Filed: Aug. 24, 2016

(65) Prior Publication Data

US 2017/0332788 A1 Nov. 23, 2017

(30) Foreign Application Priority Data

May 19, 2016 (CN) ..... 2016 2 0460439 U

(51) Int. Cl.
*A47C 3/026* (2006.01)
*A47C 3/025* (2006.01)

(52) U.S. Cl.
CPC ..... *A47C 3/0255* (2013.01); *A47C 3/026* (2013.01)

(58) Field of Classification Search
CPC ..... A47C 3/0255; A47C 3/026
USPC ..... 297/313, 314, 461
See application file for complete search history.

(56) References Cited

U.S. PATENT DOCUMENTS 4,099,697 A * 7/1978 Von Schuckmann .. A47C 3/026 297/314 X
6,106,064 A * 8/2000 Hibberd ..... A47C 3/025 297/313
6,176,548 B1 * 1/2001 Thole ..... A47C 3/026 297/302.1
6,209,958 B1 * 4/2001 Thole ..... A47C 3/026 297/302.1
6,386,635 B1 * 5/2002 Ralph ..... B60N 2/502 297/314
6,688,689 B1 * 2/2004 Thorn ..... A47C 3/0252 297/313 X
6,997,511 B2 * 2/2006 Marchand ..... A47C 9/025 297/313
7,396,080 B2 * 7/2008 Suhr ..... A47C 3/026 297/313
7,547,067 B2 * 6/2009 Keilhauer ..... A47C 3/02 297/313
7,594,696 B2 * 9/2009 Girard ..... B62J 1/08 297/313 X
7,789,463 B2 * 9/2010 Gang ..... A47C 3/0252 297/314 X
8,075,056 B2 * 12/2011 Glockl ..... A47C 3/026 297/313 X (Continued)

*Primary Examiner* — Rodney B White

(57) ABSTRACT

The present application discloses a chair with a bi-directional controllable air rod valve including a chair leg, a seat cushion, and a compression air rod that connects the chair leg and the seat cushion, where two sides of a cavity of the seat cushion are each provided with a set of valve control members. The set of valve control members disposed in the cavity of the seat cushion enables a user to adjust the chair with both left and right hands conveniently, which greatly facilitates the operation, and in addition, the hidden design of the valve control members prevents the exposed valve control members from hurting a mover or a user and meanwhile, protects the valve control members.

5 Claims, 6 Drawing Sheets

(56) References Cited

U.S. PATENT DOCUMENTS

| | | | | |
|---|---|---|---|---|
| 8,136,876 | B2 * | 3/2012 | Bellvis Castillo | A47C 9/002 297/313 X |
| 9,016,786 | B2 * | 4/2015 | Glockl | A47C 3/22 297/313 |
| 2002/0043846 | A1 * | 4/2002 | Brauning | A47C 3/026 297/314 |
| 2008/0143162 | A1 * | 6/2008 | Glockl | A47C 3/026 297/362.13 |
| 2011/0175414 | A1 * | 7/2011 | Asbjornsen | A47C 9/002 297/313 |
| 2012/0306249 | A1 * | 12/2012 | Jung | A47C 3/026 297/313 |

* cited by examiner

CHAIR WITH BI-DIRECTIONAL CONTROLLABLE AIR ROD VALVE

CROSS-REFERENCE TO PRIOR APPLICATION

This application claims the benefit of Chinese Utility Model Application No. 201620460439.7 filed on May 19, 2016, the contents of which are incorporated herein by reference.

BACKGROUND

Technical Field

The present application relates to a chair with a bi-directional controllable air rod valve.

Related Art

A chair is one of the favorite seats of people and is widely used at home, in offices, and in business halls.

Among the chairs in the prior art, there is a chair including a chair leg, a seat cushion, and a compression air rod that connects the chair leg and the seat cushion, where an upper right portion of the compression air rod is provided with a valve control member that extends outward. Disadvantages are that: because the valve control member is disposed on the upper right portion of the compression air rod, an operation can only be performed with the right hand and cannot be easily performed with the left hand, and an operation manner is limited; and in addition, the valve control member is exposed and would easily hit a human body during a moving process, resulting in existence of a potential safety risk.

SUMMARY

With regard to the foregoing technical disadvantages, the present application provides a chair with a bi-directional controllable air rod valve.

To resolve the foregoing technical problem, the technical solution of the present application is as follows:

A chair with a bi-directional controllable air rod valve includes a chair leg, a seat cushion, and a compression air rod that connects the chair leg and the seat cushion; two sides of a cavity of the seat cushion are each provided with a set of valve control members.

Further, the compression air rod is provided with a support, the valve control members include a swing arm, an end of the swing arm is lapped on a valve of the compression air rod, and the other end of the swing arm is provided with a toggle sheet; and between the swing arm and the support, a pin shaft is used as a supporting point for the swing arm to swing, and the toggle sheet controls the valve of the compression air rod by swinging the swing arm.

Further, the toggle sheet is provided with a bumping post, the swing arm is provided with a horizontal post on the end of the toggle sheet, and the swing arm, on the whole, presents a T shape; and the bumping post and the horizontal post are movably clamped to each other.

Further, the seat cushion includes a plastic cushion and a soft cushion disposed on the plastic cushion, and the plastic cushion and the support form the cavity of the seat cushion for accommodating the valve control members.

Further, a recess for accommodating the pin shaft is disposed on the support, and the plastic cushion covers the recess, so as to limit the pin shaft.

Further, the horizontal post, the pin shaft, and the swing arm are integrally formed, and the bumping post and the toggle sheet are integrally formed.

Beneficial effects of the present application are that: a set of valve control members disposed in a cavity of a seat cushion enables a user to adjust a chair with both left and right hands conveniently, which greatly facilitates the operation, and in addition, the hidden design of the valve control members prevents the exposed valve control members from hurting a mover or a user and meanwhile, protects the valve control members; moreover, the valve control members are designed as a swing arm and a toggle sheet, movable clamping between a horizontal post of the swing arm and a bumping post achieves convenient assembly, maintenance and disassembly; the pin shaft is used as a supporting point, so a valve of a compression air rod is controlled with a relatively small force by using the toggle sheet, through cooperation between a recess and a plastic cushion based on the lever principle; the horizontal post, the pin shaft, and the swing arm are integrally formed, and the bumping post and the toggle sheet are integrally formed, so as to achieve a convenient machining process and reduce machining costs.

DETAILED DESCRIPTION

Figure 1:
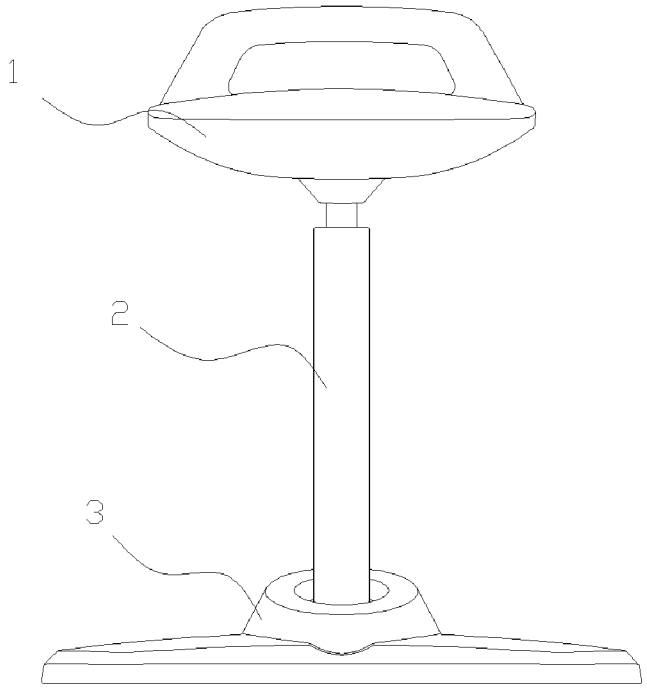
FIG. 1 is a schematic structural diagram of the present application.
Figure 2:
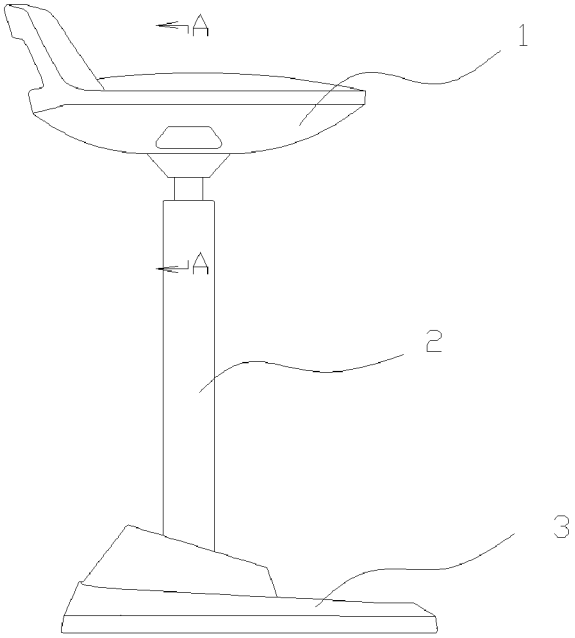
FIG. 2 is a left view of the the present application.
Figure 3:
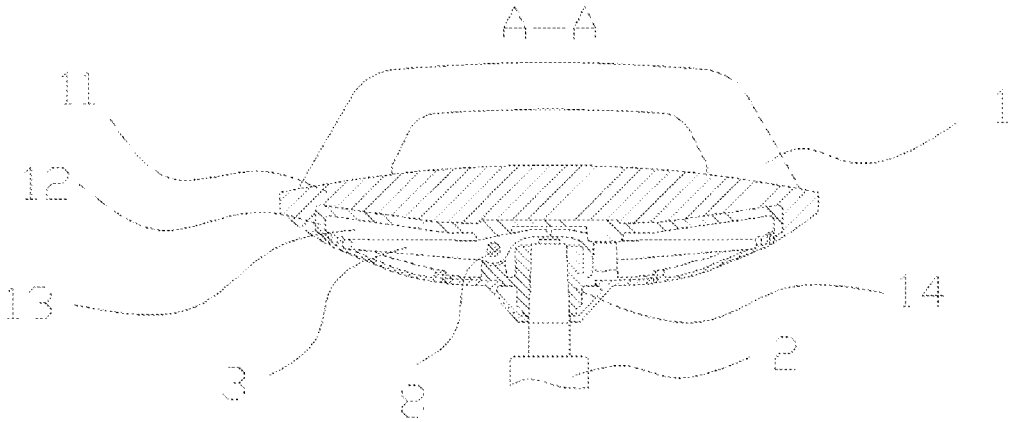
FIG. 3 is an A-A sectional diagram of FIG. 2.
Figure 4:
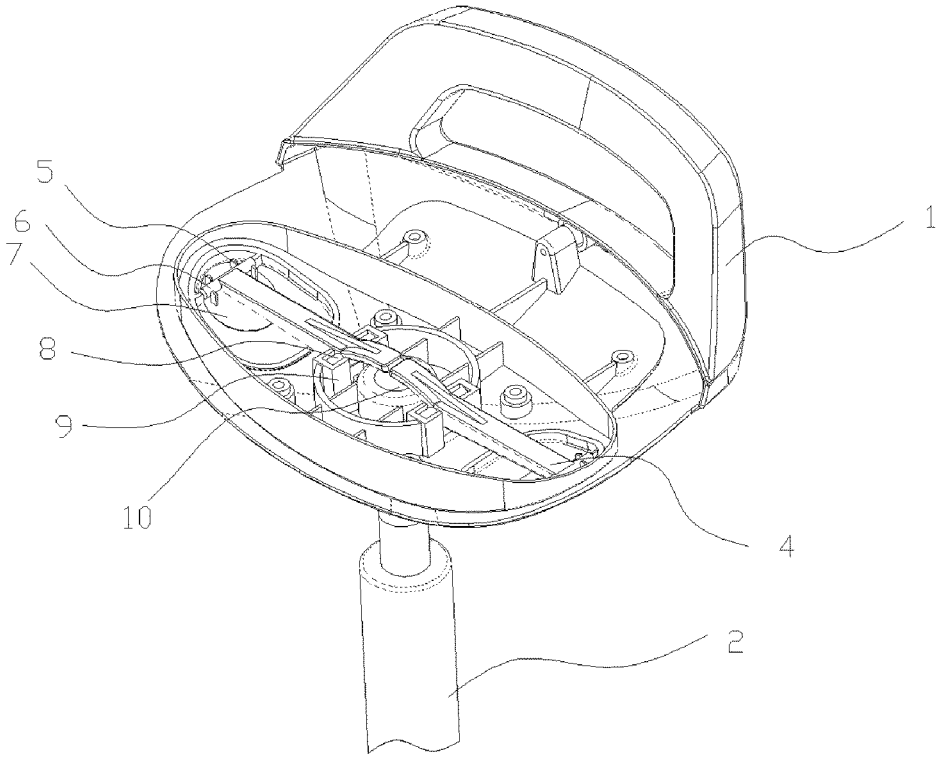
FIG. 4 is an internal anatomical diagram of the present application.

The present application is further described below with reference to the accompanying drawings and specific embodiments.

Embodiment 1

As shown in FIG. 1 to FIG. 4, a chair with a bi-directional controllable air rod valve includes a chair leg 3, a seat cushion 1, and a compression air rod 2 that connects the chair leg 3 and the seat cushion 1; and the seat cushion 1 includes a plastic cushion 12 and a soft cushion 11 disposed on the plastic cushion 12, the compression air rod 2 is provided with a support 14, the plastic cushion 12 and the support 14 cooperate with each other to form a seat cushion cavity 13 that can accommodate valve control members, and two sides of the seat cushion cavity 13 are each provided with a set of valve control members, so as to enable a user to adjust the chair with the left and right hands conveniently.

The valve control members include a swing arm 4, an end of the swing arm 4 is lapped on a valve 10 of the compression air rod 2, and the other end of the swing arm 4 is provided with a toggle sheet 7; the toggle sheet 7 is provided with four bumping posts 5, the bumping posts 5 are distributed in a trapezoidal shape, the swing arm 4 is provided with a horizontal post 6 on the end of the toggle sheet, so as to enable the swing arm 4, on the whole, to present a T shape;

a lower side of the bumping post 5 is provided with an arc shape for clamping the horizontal post 6, the horizontal post 6 and the bumping post 5 are movable to each other, so that the toggle sheet 7 is mounted on the swing arm 4 and the toggle sheet 7 and the swing arm are movable to each other, between the swing arm 4 and the support 14, a pin shaft 8 is used as as a supporting point for the swing arm 4 to swing, meanwhile, a recess 9 for accommodating the pin shaft 8 is disposed on the support 14, the plastic cushion 12 covers the recess 9, so as to limit the pin shaft 8, the toggle sheet 7 may control the valve 10 of the compression air rod by swinging the swing arm 4, and because a distance from the end, where the horizontal post 6 is the located, of the swing arm 4 to the pin shaft 8 is greater than a distance between the swing arm and the valve 10, the toggle sheet 7 can easily adjust the compression air rod 2 based on the lever principle.

To achieve convenient machining and manufacturing, the horizontal post 6, the swing arm 4, and the pin shaft 8 are manufactured by design in an integrally formed manner, and the bumping posts 5 and the toggle sheet 7 are manufactured by design in an integrally formed manner.

Embodiment 2

As shown in FIG. 5 to FIG. 11, a chair capable of swinging forward and backward is provided. To swing the chair, a lower end of the compression air rod 2 is provided with a tapered sleeve 15, the tapered sleeve 15 is disposed in a cavity of the chair leg 3, the tapered sleeve 15 is enclosed by a rubber ring 14, the rubber ring 14 includes a rubber inner wall and a rubber outer wall, a height of the rubber outer wall is slightly lower than a height of the rubber inner wall, the rubber inner wall and the rubber outer wall are combined to make a section of the rubber ring 14 present an n shape, a lower end of the rubber outer wall is provided with a metal sheet 18, and the metal sheet 18 is fixed to a plastic foot of the cavity of the chair leg 3 by using an adjustable screw bolt 17. The rubber inner wall and the tapered sleeve 15 as well as the rubber outer wall and the metal sheet 18 may be integrally formed in an injection molding manner.

Figure 5:
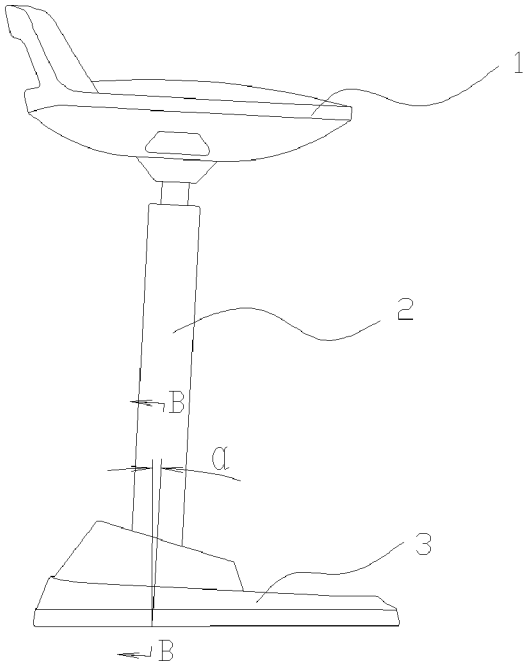
FIG. 5 is a schematic structural diagram when the present application inclines forward.
Figure 6:
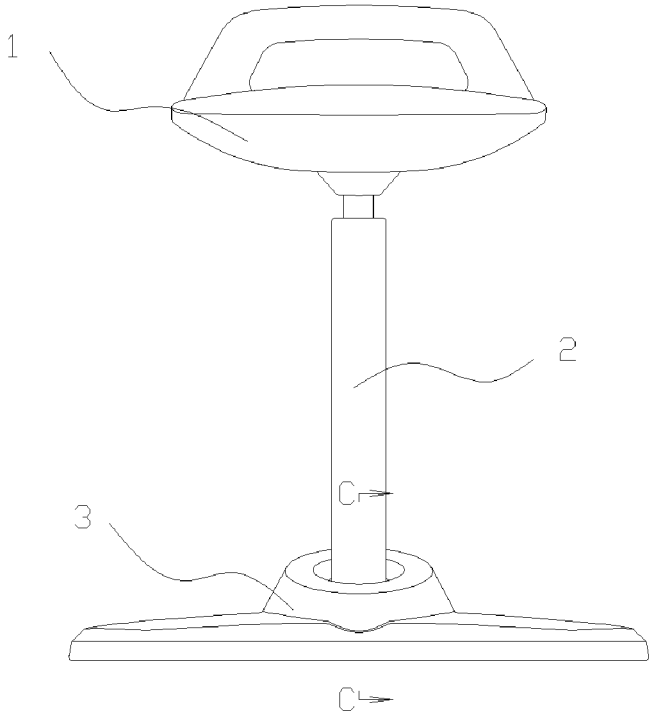
FIG. 6 is a schematic structural diagram of the present application.
Figure 7:
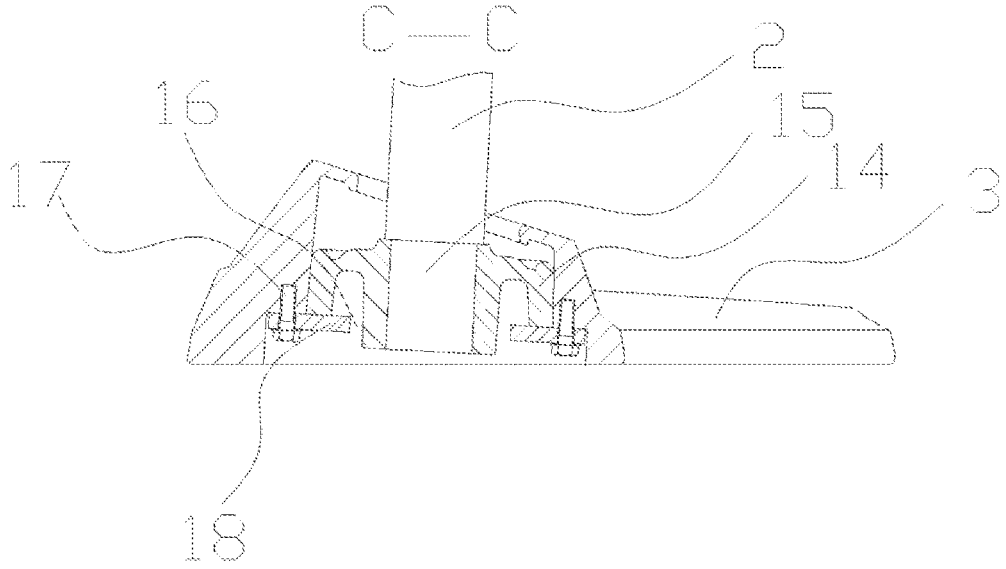
FIG. 7 is a C-C sectional diagram of FIG. 6.
Figure 8:
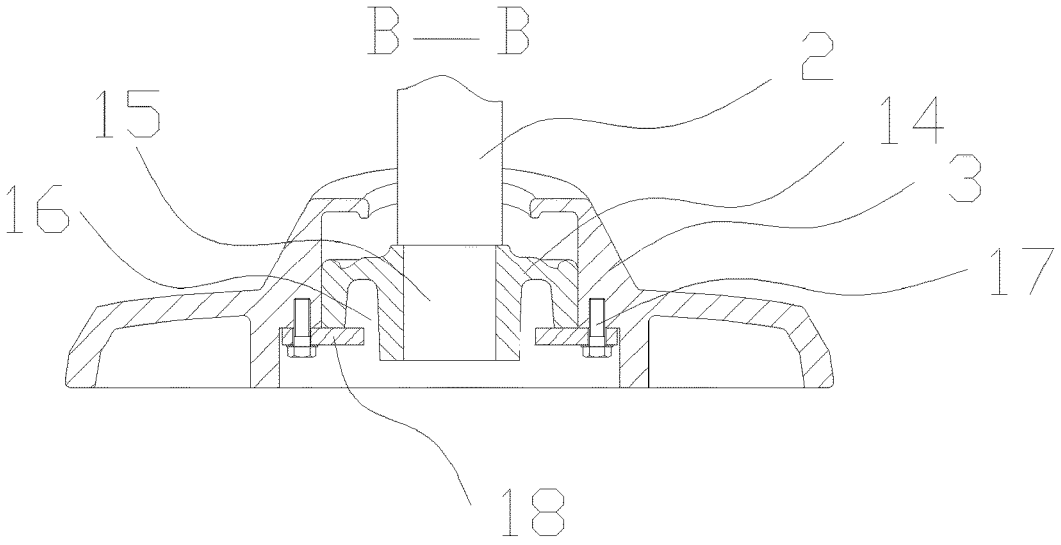
FIG. 8 is a B-B sectional diagram of FIG. 5.
Figure 9:
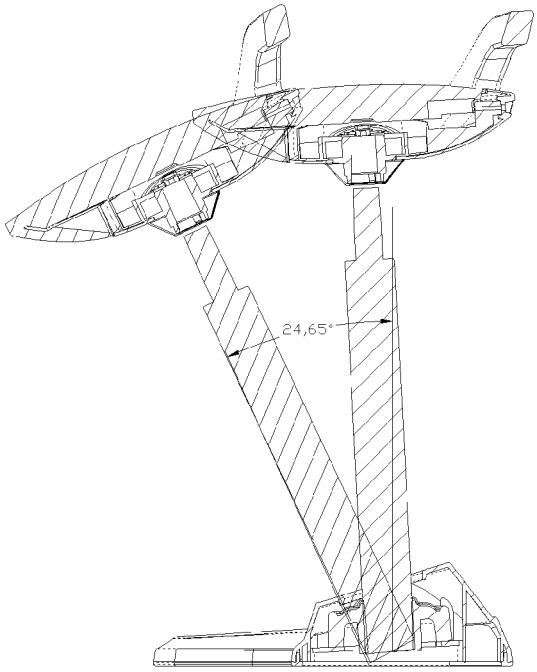
FIG. 9 is a schematic diagram of the present application that inclines forward.
Figure 10:
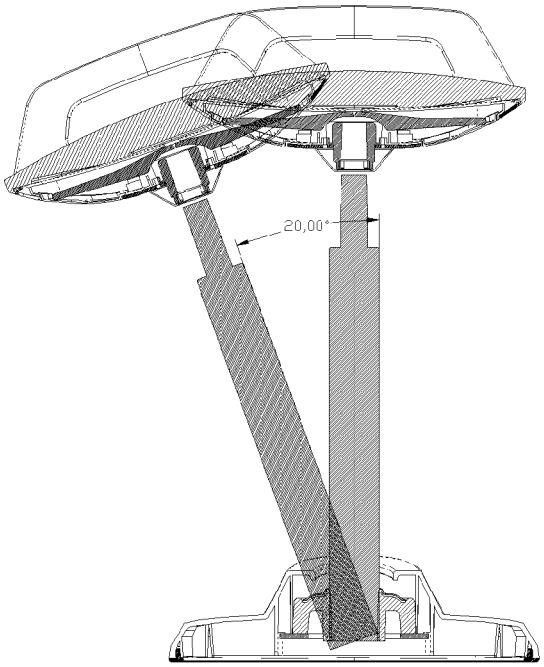
FIG. 10 is a schematic diagram of the present application that inclines leftward and rightward.
Figure 11:
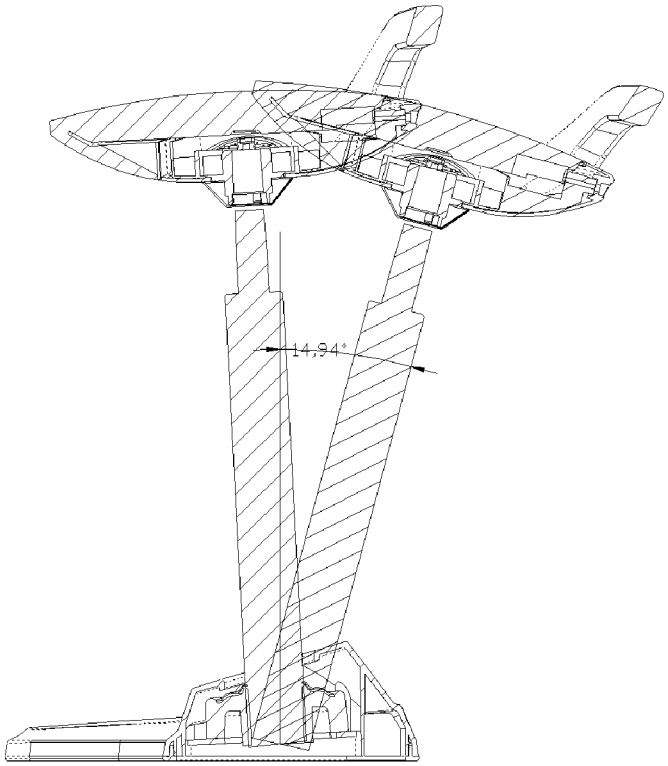
FIG. 11 is a schematic diagram of the present application that inclines backward.

Because a gap 16 exists between the rubber inner wall and the rubber outer wall, the tapered sleeve 15 at a bottom of the compression air rod 2 may incline and swing inside the gap 16, and a swinging range of the tapered sleeve 15 at the lower end of the compression air rod 2 may be further limited by using the metal sheet 18. When the metal sheet is elongated, the gap between the rubber inner wall and the metal sheet 18 is reduced, a moving range of the compression air rod 2 is accordingly limited, and when the metal sheet is shortened, the gap between rubber inner wall and the metal sheet 18 is increased, the moving range of the compression air rod 2 is accordingly enlarged. Further, preferably, as shown in FIG. 5 and FIG. 7, a height of a fixing point of a screw bolt 17 of a rear-end metal sheet 18 of the plastic foot of the chair leg 3 from the ground is higher than a height of a fixing point of a screw bolt 17 of a front-end metal sheet 18 from the ground, so as to set the compression air rod 2 to incline forward by an angle of a. By means of experiments, an adjustment range of a forward inclination angle is kept from 0 to 25 degrees, an adjustment range of a backward inclination angle is kept from 0 to 15 degrees, and an adjustment range of a leftward/rightward inclination angle is kept from −20 to 20 degrees.

The above descriptions are merely preferred embodiments of the present application, and it should be noted that several improvements and modifications can be made by those of ordinary skill in the art without departing from the concept of the present application, and the improvements and modifications may also be considered to fall within the protection scope of the present application.

What is claimed is:

1. A chair with a bi-directional controllable air rod valve, comprising: a chair leg, a seat cushion, and a compression air rod that connects the chair leg and the seat cushion, wherein two sides of a cavity of the seat cushion are each provided with a set of valve control members; wherein the compression air rod is provided with a support, the valve control members comprise a swing arm, an end of the swing arm is lapped on a valve of the compression air rod, and the other end of the swing arm is provided with a toggle sheet; and between the swing arm and the support, a pin shaft is used as a supporting point for the swing arm to swing, and the toggle sheet controls the valve of the compression air rod by swinging the swing arm.

2. The chair with a bi-directional controllable air rod valve according to claim 1, wherein the toggle sheet is provided with a bumping post, the swing arm is provided with a horizontal post on the end of the toggle sheet, and the swing arm, on the whole, presents a T shape; and the bumping post and the horizontal post are movably clamped to each other.

3. The chair with a bi-directional controllable air rod valve according to claim 2, wherein the horizontal post, the pin shaft, and the swing arm are integrally formed, and the bumping post and the toggle sheet are integrally formed.

4. The chair with a bi-directional controllable air rod valve according to claim 1, wherein the seat cushion includes a plastic cushion and a soft cushion disposed on the plastic cushion, and the plastic cushion and the support form a seat cushion cavity for accommodating the valve control members.

5. The chair with a bi-directional controllable air rod valve according to claim 4, wherein a recess for accommodating the pin shaft is disposed on the support, and the plastic cushion covers the recess, so as to limit the pin shaft.

* * * * *